US009132995B2

(12) United States Patent
Schafer

(10) Patent No.: US 9,132,995 B2
(45) Date of Patent: Sep. 15, 2015

(54) APPARATUS, SYSTEM AND METHOD FOR CONTROLLABLE GRAPPLING HOOK

(71) Applicant: George H Schafer, Enfield, CT (US)

(72) Inventor: George H Schafer, Enfield, CT (US)

(73) Assignee: Innovative Minds LLC, Enfield, CT (US)

( * ) Notice: Subject to any disclaimer, the term of this patent is extended or adjusted under 35 U.S.C. 154(b) by 62 days.

(21) Appl. No.: 14/097,238

(22) Filed: Dec. 4, 2013

(65) Prior Publication Data

US 2015/0151950 A1 Jun. 4, 2015

(51) Int. Cl.
*B66C 1/22* (2006.01)
*B66C 1/34* (2006.01)

(52) U.S. Cl.
CPC ..... *B66C 1/34* (2013.01)

(58) Field of Classification Search
USPC ..... 294/82.3, 82.31, 82.34, 66.1, 82.24, 294/82.33, 82.26, 82.1; 244/118.1, 137.1, 244/137.4
See application file for complete search history.

(56) References Cited

U.S. PATENT DOCUMENTS

| | | | | | |
|---|---|---|---|---|---|
| 1,632,529 | A | * | 6/1927 | Bauer | 114/305 |
| 4,185,864 | A | * | 1/1980 | Phillips et al. | 294/82.3 |
| 4,336,926 | A | * | 6/1982 | Inagaki et al. | 294/119.2 |
| 4,416,480 | A | * | 11/1983 | Moody | 294/82.34 |
| 4,715,631 | A | * | 12/1987 | Nakajima | 294/2 |
| 4,936,617 | A | * | 6/1990 | Greene et al. | 294/82.3 |
| 6,079,761 | A | * | 6/2000 | Sadeck | 294/82.1 |
| 6,530,614 | B1 | * | 3/2003 | Wooten et al. | 294/82.1 |
| 8,919,844 | B1 | * | 12/2014 | Mascorro et al. | 294/197 |
| 2003/0189349 | A1 | * | 10/2003 | Risle et al. | 294/119.1 |

* cited by examiner

*Primary Examiner* — Paul T Chin
(74) *Attorney, Agent, or Firm* — Wasserbauer Law LLC; Damian Wasserbauer, Esq.

(57) ABSTRACT

The present invention is a controllable hook assembly having an actuator connected by a clutch to a drive assembly configured to limit the connection to a predetermined linear force applied to the actuator. The drive assembly and actuator of the controllable hook assembly also is configured to move a plurality of hook arms between an open and closed position and is adapted capturing a line attached to a load. A controller is configured to operate the drive assembly to move gear teeth in the hook arms cooperating with screw threads in said actuator to provide rotation about a pivot point, drive an actuator output shaft such that when the actuator is energized the linear motion of the actuator output shaft moves the hook arms between an open and a closed position so as to allow for repeated capture of loads by helicopter or other lifting devices without the need for extensive setup for such load capture.

15 Claims, 6 Drawing Sheets

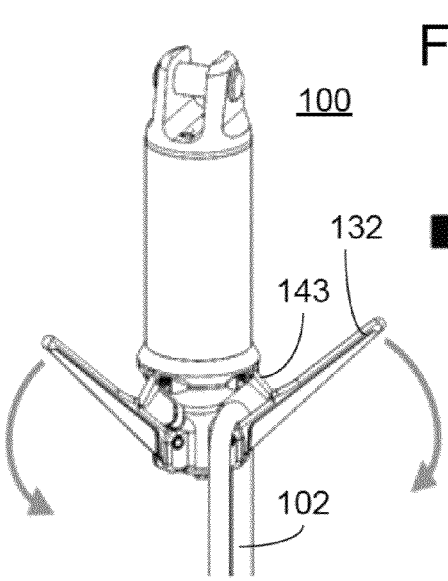
FIG. 4A
FIG. 4B
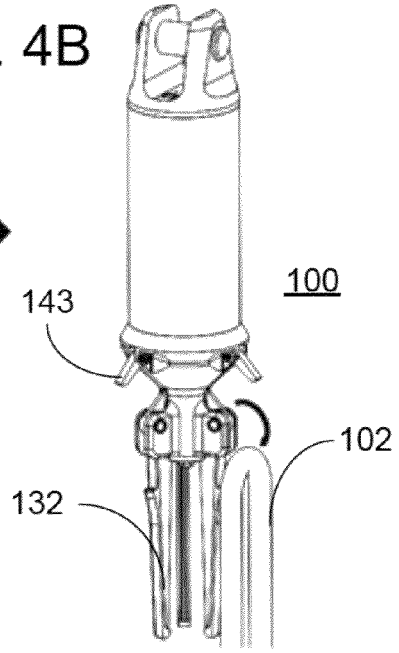
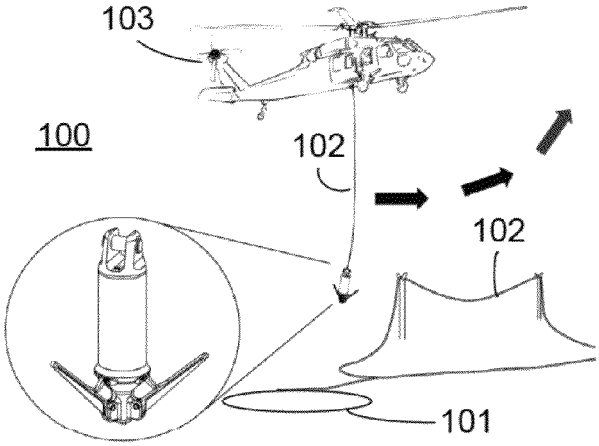
FIG. 5A
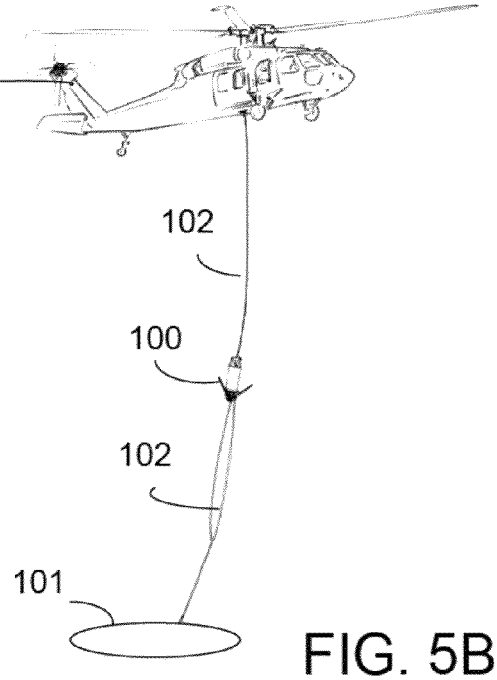
FIG. 5B

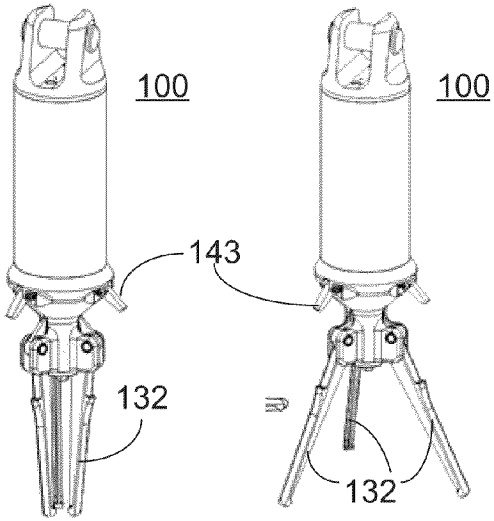
FIG. 8A
FIG. 8B
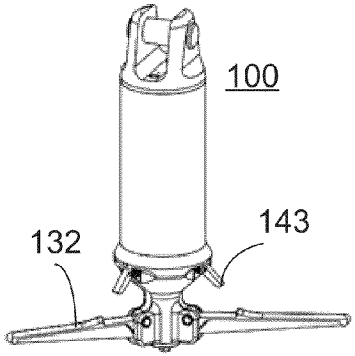
FIG. 8C
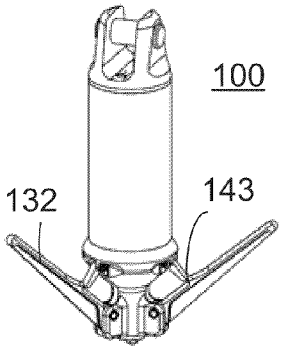
FIG. 8D
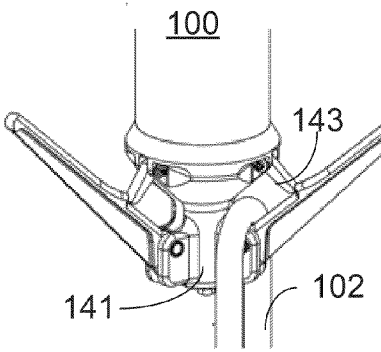
FIG. 9A
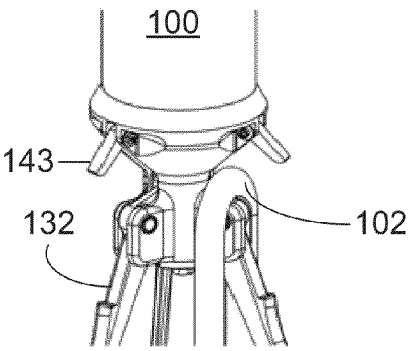
FIG. 9B
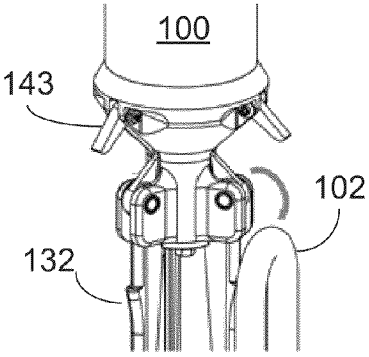
FIG. 9C

APPARATUS, SYSTEM AND METHOD FOR CONTROLLABLE GRAPPLING HOOK

FIELD OF THE INVENTION

The present invention is an apparatus, system and method for a controllable hook assembly used to capture of payloads without the use of ground or attendant personnel to secure the load on the hoisting device and, more particularly, to a hook assembly capable of controlling the position of its hook arms.

BACKGROUND OF THE INVENTION

Conventional devices, systems and methods for picking up external payloads using helicopters, or other lifting devices, currently require one or more attendants to hook up the payload to the lifting device located: (1) at or near the payload, and (2) under the lifting device. Typically, an attendant is subject to the threat of injury due to the proximity to the lifting platform as well as from a swinging payload once the payload is airborne. In contested military situations, the attendant creates the need for other personnel to aid in securing the area, expanding the cost and threat of the lifting operation. Accordingly, conventional devices have the disadvantages such as, for example, the need for an attendant, the risk of injury to the attendant, and the additional cost for an attendant.

What is desired, then, is an improved, low cost, efficient and effective apparatus, system and method for picking up external payloads using helicopters, or other lifting devices. The present invention is a device designed to eliminate the need for the attendant. The apparatus is configured to be easy to implement as well as it does not require extreme accuracy of the lifter. Finally, the present invention eliminates the need for the purchase of multiple devices. As a result, the present invention has advantages that allow for repeated capture of loads by helicopter or other lifting devices without the need for extensive setup for such load capture.

SUMMARY OF THE INVENTION

It is an object of the present invention to provide a low cost efficient and effective apparatus, system and method to capture a load without the use of ground or attendant personnel to secure the load on the lifting device and more particularly to a grappling hook capable of controlling the position of its grappling arms.

It is an object of the present invention to provide an apparatus, system and method for a lifting device that eliminates the need for an attendant to secure the load to the lifting device.

It also is an object of the present invention to provide a device that can be implemented with little to no modification to the lifting platform.

It is yet another object of the present invention to provide a means to capture the load or payload without the need for additional special equipment.

It is another object of the invention to allow the lifting device operator to control the position of the load-capture arms to facilitate load capture and release.

It is another object of the present invention to minimize the accuracy needed by the lifting device operator to capture the payload.

It is a further object of the invention to allow installation on any platform intended to lift payloads.

It is also an object of the invention to allow use of the device in any environment, whether the payload is on the ground, in the air, or in water.

It is an object of the invention to prevent the load from escaping by using "keepers".

It is an object of the invention to provide operational status and usage information to the user.

It is an object of the invention to allow the user to interrogate the controller for operational status and usage information.

It is another object of the invention to use the usage information for condition based maintenance.

It is also another object of the invention to allow additional functionality to be easily added to the controller by using a programmable controller.

It is an object of the invention to provide wireless operation using a wireless controller.

It is yet another object of the invention that the status of the hook (including position, power state, errors/faults) may be presented to the user via secondary indicators, including but not limited to colored illumination, audio enunciation, or haptic feedback

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of the Embodiments, which is to be read in association with the accompanying drawings, which are incorporated in and constitute a part of this specification, show certain aspects of the subject matter disclosed herein and, together with the description, help explain some of the principles associated with the disclosed implementations, wherein:

FIGS. 4A and 4B illustrate a schematic diagram of the apparatus, system, and method in a lifting operation in accordance with an embodiment of the present invention;

FIGS. 5A and 5B illustrate a capture the load capture operation utilizing the hook assembly and controller of the present invention;

FIGS. 8A, 8B, 8C, and 8D illustrate the open, selective intermediate, and closed positions the hook assembly of the present invention; and FIGS. 9A, 9B, and 9C illustrate a schematic view of a capture member releasing feature of the capture arm that pushes the capture member off the hook assembly.

DESCRIPTION OF THE EMBODIMENTS

Figure 1A:
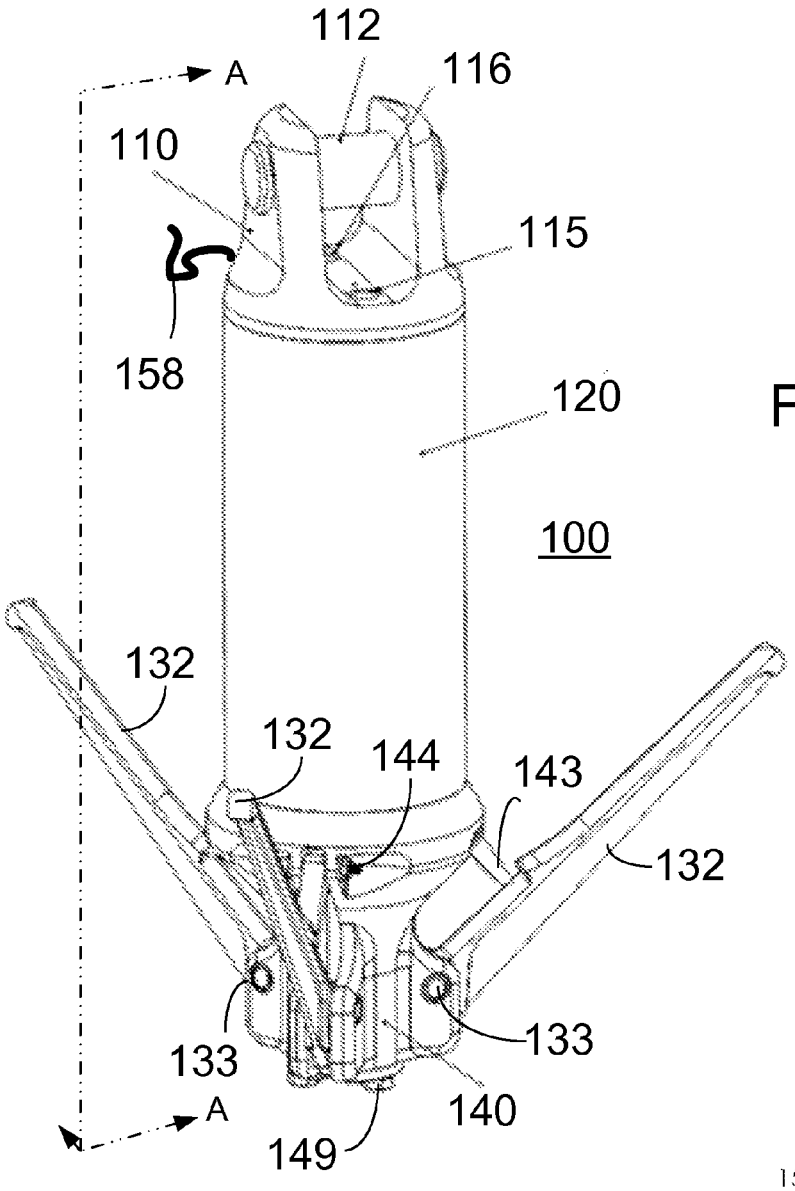
FIGS. 1A and 1B illustrate a schematic diagram of the hook assembly and controller of the apparatus, system, and method in accordance with an embodiment of the present invention.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, and as shown in all of the drawings including FIGS. 1A and 1B through 9A and 9C, the term "controllable hook" or "hook assembly" refers to an apparatus, system and method for a grappling hook that eliminates the need for an attendant to secure the payload to the lifting device. The controllable hook can be implemented with little to no modification to the lifting platform. The controllable hook can be implemented with a means to capture the payload without the need for additional special equipment. The controllable hook can be controlled thereby allowing the lifting device operator to control the position of the load-capture arms to facilitate load capture and release as is illustrated in FIGS. 2, 3A, 3B, 4A to 4B, 5A to 5B, 6A to 6C, 7, 8A to 8D, and 9A to 9B. The controllable hook can minimize the accuracy needed by the lifting device operator to capture the payload. The controllable hook can allow installation on any platform intended to lift payloads and allow use of the device in any environment, whether the payload is on the ground, in the air, or in water.

As used herein, and as shown in drawings FIGS. 4A and 4B, 5A and 5B, 7A, 7B and 7C through 9A and 9C, the term "line" refers to a line, cable, chain, rope or other device. The line 102 can to secure a load to the hook assembly 100. Similarly the line 102 can secure the hook assembly 100 by looping around the pin 112 of the upper assembly 110 to the lifting means such as a helicopter as shown in FIGS. 5A and 5B. In most cases this will be via a flexible cable, rope, chain, or other structurally sound means of connecting the two. Line can also refer to a communication line such as a cable Referring now to FIGS. 1A, 1B, 2 and 3, a controllable hook apparatus, system and method is shown generally as hook assembly 100. The hook assembly 100 is configured with an upper assembly 110, a main body 120, a drive assembly 130, a lower assembly 140, and a controller 150. The drive assembly 130 is housed within the main body 120 of the hook assembly 100. The upper and lower assemblies 110 and 140, respectively, are structurally joined to the main body 120 so as to provide a hook assembly 100 adapted to operate on dead, live, and varying dynamic loads for a maximum expected load scenario, for example, all the forces that are variable within the object's normal operation cycle including construction, environmental, impact, momentum, vibration, slosh dynamics of fluids, fatigue, environmental and other design factors as is illustrated in FIGS. 4A, 4B, 5A, 5B, and 6A, 6B and 6C. Accordingly, and as is further set forth herein, the hook assembly 100 provides unique advantages including a low cost efficient and effective apparatus, system and method to capture of payloads without the use of ground or attendant personnel to secure the load on the lifting device.

Figure 2:
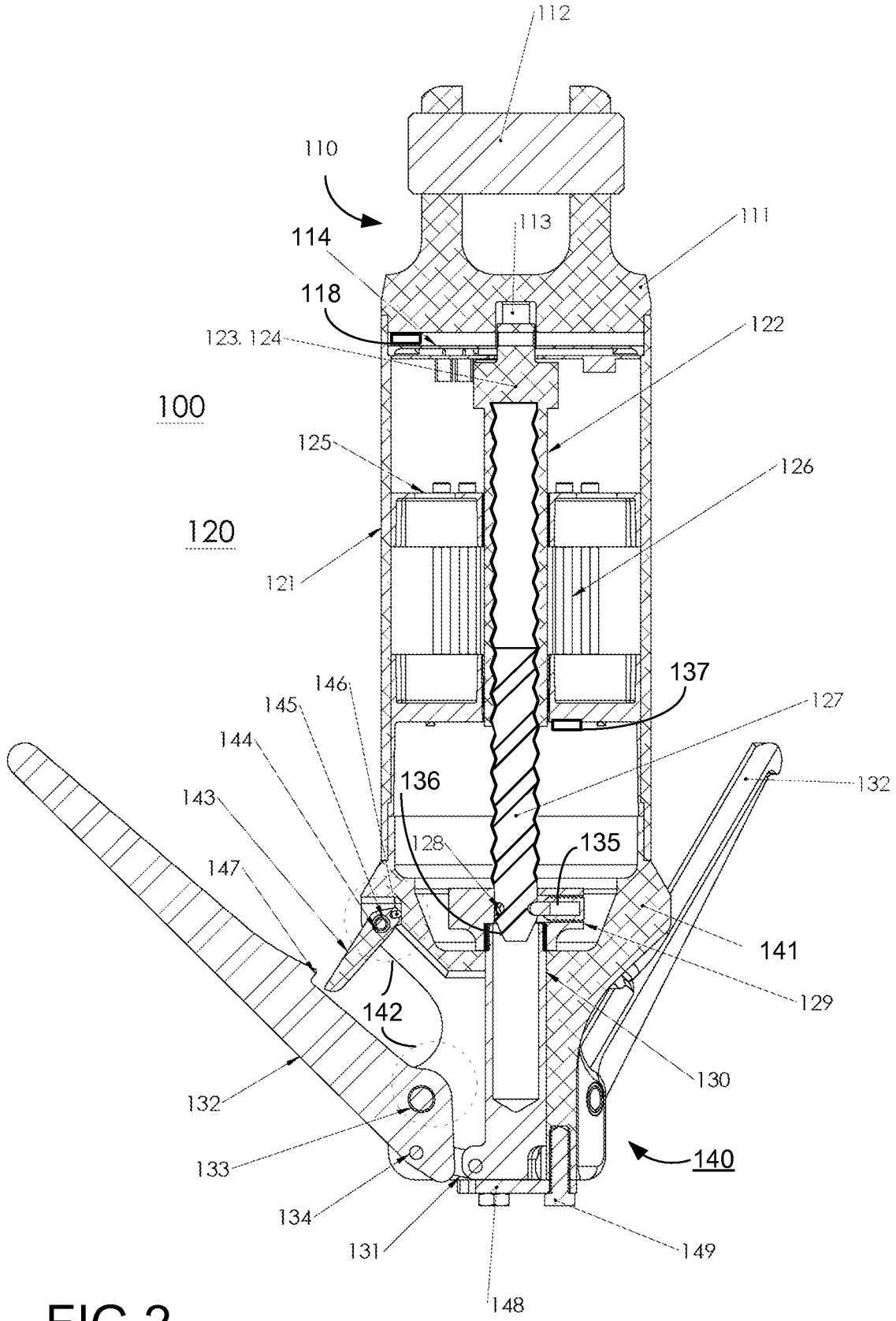
FIG. 2 illustrates a cross sectional, schematic diagram of the hook assembly in the closed position, taken along lines A-A of FIG. 1A re-oriented 180 degrees with threaded actuator output shaft cooperating with the actuator to move the plurality of hook arms, in accordance with an embodiment of the present invention.

As illustrated in FIGS. 1A, 2 and 3, the upper assembly 110 is configured with a cap 111, a pin 112, a plurality of ports 113, and a control circuitry 114. The cap 111 is configured to support the pin 112. The cap 111 and pin 112 provide a point of attachment for an external lift line 102 (not shown). The upper assembly 100 can be designed to withstand various loads applied to the pin 112 so as not to fail, to securely attach to the external lifting device, to accept special lifting attachment features, and to provide support for circuitry or other power supply means.

Figure 7:
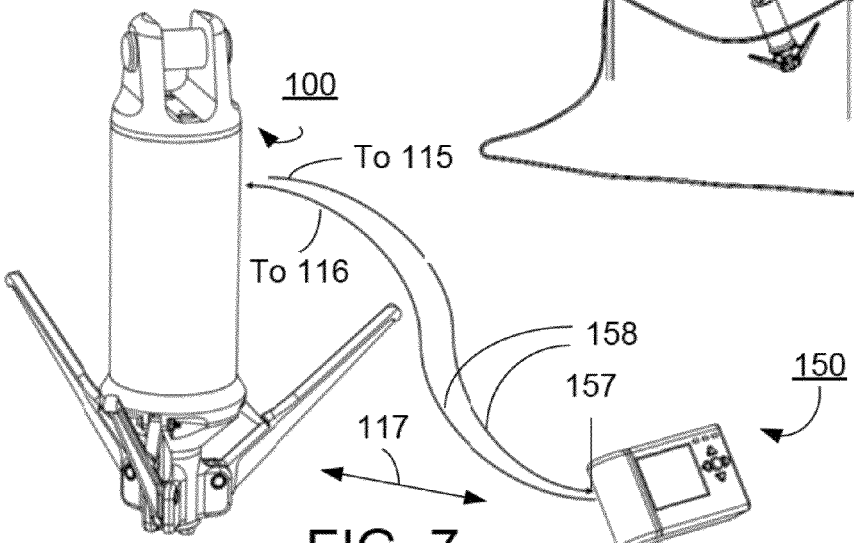
FIG. 7 illustrates a schematic view of wireless operation of the hook assembly and controller.

As shown in FIGS. 2 and 3, the plurality of ports 113 connect to the control circuitry 114 disposed on the opposite side of the cap 111 so as to protect from environmental factors. The ports can include, for example, a charging connection port 115 and user interface connection port 116 as shown in FIG. 1A. The charging connection 115 provides an external connection to the control circuitry, battery charger and the internal battery as described herein. The user interface connection port 116 provides a port 113 for a wired connection to control circuitry 114 adapted to establish a user interface into the operation of the hook 100. Either a new port 113 or the port of the user interface connection port 116 also can be used for a wireless antenna 117 in wireless configuration so as to provide operational status and usage information to the user as is shown in FIG. 7

The control circuitry 114 provides for bi-directional communications, motor control, system monitoring and other functions and features of the hook assembly 100. The control circuitry 114 is configured to provide bi-directional communications between the controller 150 and the hook 100 adapted to monitor and provide a status of the various features and operation of the hook 100. The control circuitry 114 is configured to provide control of the drive mechanism, the actuator and motor. The control circuitry 114 is configured to provide system control and monitoring of the features and operation of the hook assembly 100. The control circuitry 114 can be connected to a battery charger and adapted to monitor and provide a status of the charge of the internal battery 126. The control circuitry 114 of the present invention is adapted to allow the user to interrogate the controller 150 for operational status and usage information. The control circuitry 114 can be configured to operate with a transmitter, receiver and/or transceiver so as to provide wireless operation to the hook assembly 100 using a wireless controller 150 as shown in FIG. 7.

Advantageously, the operational status and usage information allows the operator to use the usage information for condition based maintenance. Moreover, the control circuitry 114 can be configured with a programmable controller 118 adapting for additional functionality on the status of the hook 100 including position, power state, errors, faults as well as adding other functionality as desired.

As illustrated in FIGS. 1A, 2 and 3, the main body 120 of the hook assembly 100 is configured to enclose the hook assembly 100 components including the actuator 122, drive assembly 130, motor 123, battery 126, and control circuitry 114 and to shield these from external environmental factors and forces during operation. The main body 120 of the hook assembly 100 also is a structure configured to connect to the upper and lower assemblies 110 and 140, respectively, and provide a unitary assembly able to withstand failure when placed under a load in a grappling, carrying or other operation. The main body 120 is configured with a housing 121 that can be a cylindrical tube-shaped body manufactured from suitable material and metals, including alloys and functioning to provide a load path between the upper and lower assemblies 110 and 140 and an enclosure for the hook assembly 100 components. The main body 120 can connect to the upper and lower assemblies 110 and 140 by suitable means including threaded connections, fasteners and the like so as to be disassembled for repair, upgrade and maintenance.

The main body 120 also encloses linear motion device or actuator 122, motor 123, gearing or gearbox 124, battery mount 125, battery 126, an actuator output shaft 127 with a ringed notch 128 at a distal end, a linear force-limiting clutch 129, and drive shaft assembly 130. The actuator 122 is configured to provide a driving force for articulating the arms of the hook assembly 100. The hook arms 132 of the hook assembly 100 are moved between the open and closed position by the operation of the actuator 122 as is shown in FIGS. 4A and 4B. The battery 126 functions as an energy source to energize the actuator 122 and other electronics in a self contained assembly 100. Alternatively, the energy or power source can be derived from any acceptable means and can be positioned outside of the main body 120.

The actuator 122 is connected to the motor 123 via the gearbox 124 so as to transfer the motor's rotational motion to a linear motion useful for moving the actuator output shaft 127 between up and down positions, thereby opening and closing the arms. The motor 122 and gearbox can be a transaxle system. The notch 128 on the distal end of the actuator output shaft 127 engages with the linear force-limiting clutch 129. The clutch 129 is a connection between the actuator 122 and the drive shaft assembly 130. The clutch 129 provides shock absorption and force limiting means so as to minimize and limit direct impacts of a load applied to the actuator 122 by releasing or deflecting under impacts to hook arms 132.

The clutch 129 comprises functions to provide a means of bi-directional release between the drive shaft assembly 130 and the actuator 122 at a predetermined load level. The level of predetermined load is designed to protect the actuator 122 from overloads, as well as the motor 123 and gearbox 124, when these generate linear motion in the closing or opening actions. The level of predetermined load is configured to hold the clutch 129 under normal operation and provide a sufficient connection to sustain actuation in operation while loads are placed on the hook arms 132. Impacts outside the level of predetermined load will release the clutch 129 such as forces that are generated from impacts to the hook arms 132.

The clutch 129 design advantageously allows for reduction in space, weight, and power factors of the actuator 122, as these can be minimized to provide movement of the hook arms, 132. Moreover, advantages in the design allow the hook assembly to handle loads and then to protect against large lever loads that can be generated by impacts to the hook arms 132 and transmitted to the actuator 122. The clutch 129 configuration consists of pre-loaded spring pins mounted in the clutch assembly 129, and aligned with notch 128, which is contoured to provide a connection up to the level of the predetermined load, above which it will release.

The clutch 129 can be configured with a spring pin 135 that can is available from various manufacturers, designed with a predetermined bias, and can be selected for the desired predetermined load. The contoured nose 136 on the end of shaft 127 is designed to re-engage the clutch 129, i.e. the actuator 122 to the drive shaft assembly 130, at a force which the actuator 122 can sustainably provide, thus allowing the ability to re-engage during operation after a disengaging impact. The programmable controller 118 can, or can have computer implemented software program to, execute a process to provide for automatic re-engagement that advantageously reconnects the actuator 122 and drive shaft assembly 130 without the need for operator intervention. Moreover, the process can utilize on or more position sensors 137 that detect clutch 122 disengagement and computer implemented software process can actuate the actuator 122 in the appropriate direction for re-engagement.

The lower assembly 140 includes a support structure or body 141 with the drive shaft assembly 130 at a centered, mid-portion thereof, one or more intermediate links 131, one or more hook arms 132, one or more arm pivot pins 133 and one or more intermediate link pins 134. The drive shaft assembly 130 functions to articulate the hook arms 132, thereby providing over-center locking when in the capture (arms up) position. The drive shaft assembly 130 connects to each hook arm 132 using an intermediate link 131 being secured to these by the intermediate link pins 134. The support structure body 141 of the lower assembly 140 comprises surfaces and means 142 for mounting a keeper arm 143, keeper pivot pin 144, spring 145, soft stop 146 and hard stop 147.

As shown in FIGS. 1A, 2 and 3, the lower assembly 140 further includes an end cap 148 secured to the support structure body 141 by fasteners 149. The end cap 148 functions to enclose the bottom bore of the support structure body 141 and to provide a reaction surface for drive shaft assembly 130 and intermediate links 131 when in over-center lock position. The fasteners 149 function to provide structural load integrity as well as to secure the end cap 148 to the support structure body 141.

The support structure body 141 can be formed from suitable materials such as metals and alloys. The support structure body 141 provides means for mounting 142*a* plurality of keeper arms and pivot points for the hook arms 312. Suitable mounting points for hook arms 132 and keeper arms 143 use an integral lug surface for attaching suitable fasteners and pins. Any number of hook arms 132 may be provided as is acceptable for a desired application, and thereby formed integral to the support structure body 141. In one embodiment, the support structure body 141 comprises surfaces and means for mounting 142 the hook arms 143 and arm pivot pins 144 thereto so as to allow the arms to articulate between an open and closed position. The support structure body 141 further provides a bearing surfaces for the keeper soft stop 146. The support structure body 141 also provides axial support for the drive shaft assembly 130. Additionally, support structure body 141 contains a curved surface for a load path between hook arms 132 and body tube for nestling the line 102 when carrying the load 101 as shown in FIGS. 4A and 4B.

Figure 3A:
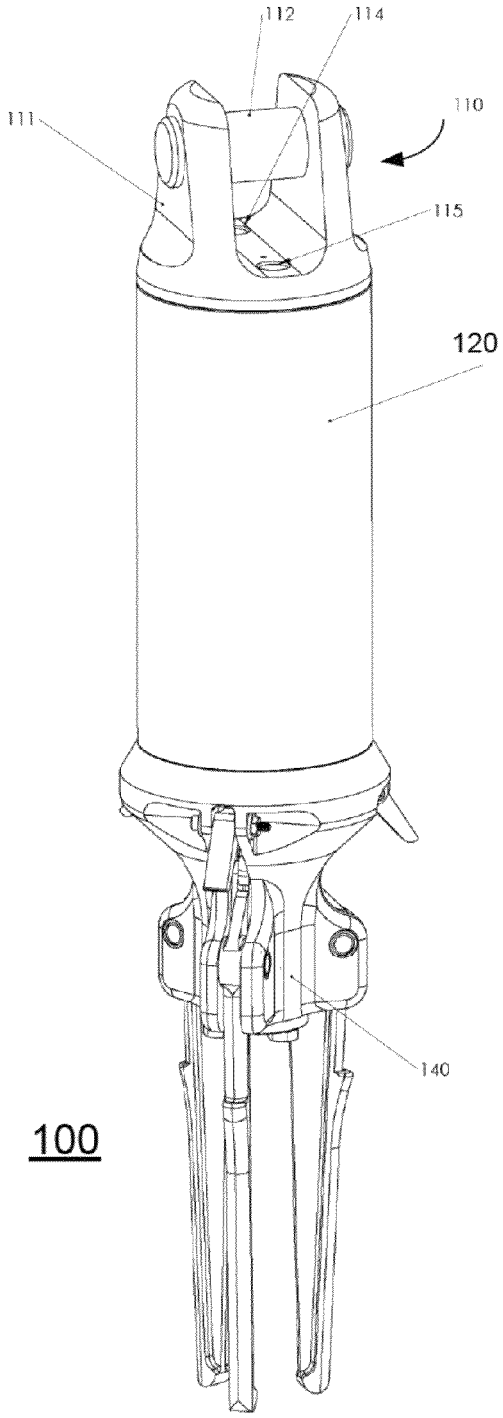
FIGS. 3A and 3B illustrate a schematic diagram of the hook assembly in the open position in accordance with an embodiment of the present invention.
Figure 3B:
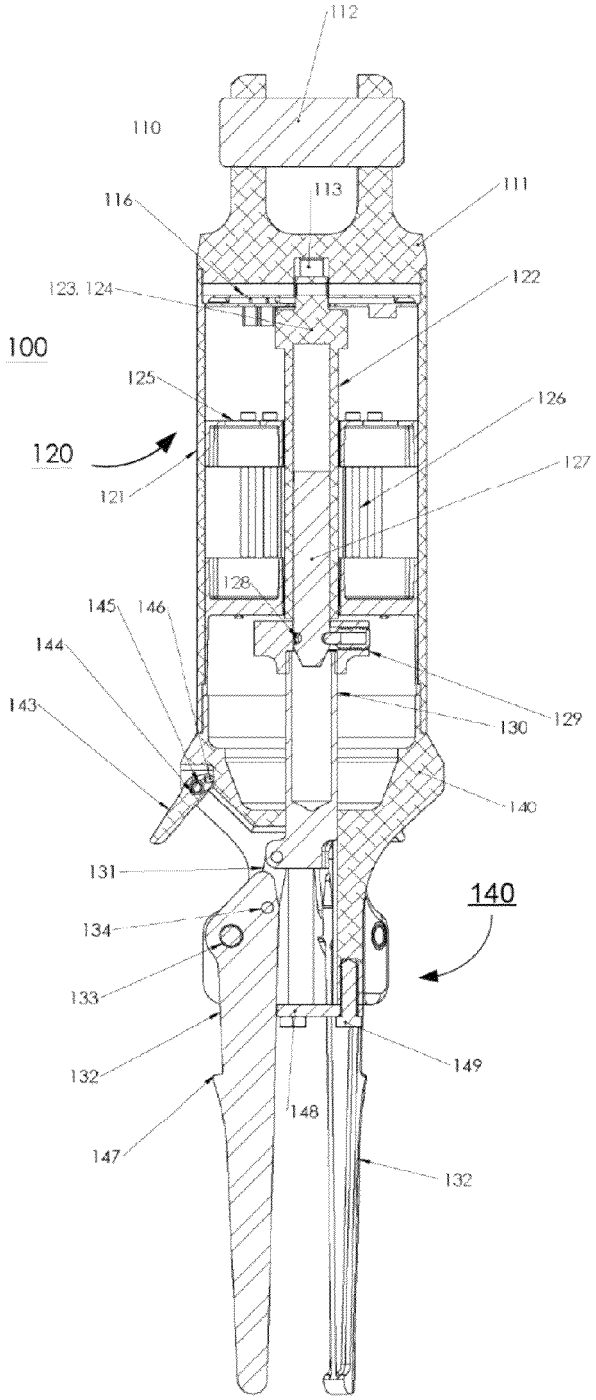

As shown in FIGS. 2 and 3B, the lower drive shaft assembly 130 attaches to the hook arms 132 by a plurality of intermediate links 131 and intermediate link pins 134. Each hook arm 132 has a predetermined shape of a generally elongated arm with a side portion adapted to provide a keeper hard stop 147. Each hook arm 132 has an integral lug for attaching to the intermediate links 131 with the intermediate link pins 134. Each intermediate link 131 functions to connect the drive shaft lugs 142 to arm pivot pins 133, thereby transitioning the hook arms 132 through 90 degrees of travel as well as providing an open position and a closed position. The intermediate link pins 134 function as pivots for the hook arms 132 and other parts to rotate relative to each other.

The keeper arm 143 functions to provide positive retention of any cable, chain, rope or other loop once captured by the arms. Keeper arms 143 have an integral lug to accept a pivot pin 143. Keeper arms 143 are free to articulate around the pivot pin 144. Keeper arms 143 are configured to otherwise move in a direction inward toward the body 141 thereby aiding in capturing any cable, chain, rope or other loop. Keeper arms 143 are further biased, or otherwise are spring-loaded by the spring 145, so as to return to an extended (outward) position, after the cable slides down the arm, thereby trapping the cable behind the keepers. Each spring 145 functions to drive a keeper arm 143 outwardly, until resting against soft stop 146, and can be manufactured from suitable springs, for example, torsion springs.

Referring to FIGS. 4A, 4B, 5A and 5B, in operation, once power is supplied, the actuator output shaft 127 is driven, in a first motion or action, down or towards the drive shaft assembly 130. As is illustrated in FIGS. 2 and 4A, in a first motion to close the hook arms 132, the actuator output shaft 127 imparts motion to the drive shaft assembly 130 thereby actuating the hook arms 132 into a closed position. As is illustrated in FIGS. 3 and 4B, in a second movement or action, the hook arms 132 are released to an open position by driving the actuator 122 up or away from the drive shaft assembly 130.

The actuator 122 can be energized by a selection on the controller 124, to cause linear travel of the actuator output shaft 127 as coupled to the clutch 129, and the drive shaft assembly 130. The power to energize the actuator 122 is provided by one or more batteries 126, or other energy source which can include direct wiring from an external power source, which are housed/mounted in the battery mount 125. As the actuator 122 drives the actuator output shaft 127 and the drive shaft assembly 130 downwardly, the intermediate links 131 push on the hook arms 132 via the intermediate link pins 134 thereby causing the hook arms 132 to rotate about the hook arm pivot pin 133. The hook assembly 100 can thus move the hook arms 132 between an open and closed position by moving the drive shaft assembly 130 up or down with the actuator 122, thereby rotating the hook arms 132 between open and closed positions respectively.

Once the actuator moves past a predetermined point, the intermediate links 131 rotate past a position normal or perpendicular to the drive shaft assembly 130, thereby creating an over-center lock. The over-center lock feature functions to prevent loads from pushing along the axis of the drive shaft assembly 130 and actuator 122 while under load, which can cause actuator 122 to fail, or linear clutch 129 to release, to fail under the load weight, thereby dropping the load. Moreover, the axial component of the load is transmitted to the drive shaft assembly 130 from the moment around the hook arm pivot 133 through the intermediate links 131. Moreover, the load is not imparted to the drive shaft assembly 130 because any load on the hook arms 132 is imparted towards the end cap 148 affixed by fasteners 149 to the support structure body 141. In this manner, the configuration of the present invention advantageously prevents external load forces from causing axial motion towards the drive shaft assembly 130, which would damage the actuator 122 so as to prevent future opening and closing, and locking the hook arms 132 in place when carrying an external load.

The hook assembly 100 is comprised of at least one hook arm 132, and can be configured with as many hook arms 132 as is required for a capture operation. In an embodiment according to the present invention, three hook arms 132 are used being what is shown and practical in most situations, but is limited only by what is geometrically possible within the acceptable geometric boundary envelope for a particular application of the hook assembly 100.

The drive assembly 130 secures to the actuator 122 through the force limiting clutch 129. The linear force limiting clutch 129 functions to prevent any external shock loads from damaging the drive shaft assembly 130 when the hook arms 132 are in transition—between open and closed positions—and are not in the over-center locked position, or in other positions other than the capture position. In this manner, the structure of the present invention has advantages that prevent transmission of forces of excessive loads to the actuator 122 that can cause damage thereto. Excessive forces can be common in operation and certain types of shocks imparted by loads, for example, shocks can occur during use of the hook assembly 100 when the assembly contacts the ground, nearby structures, obstacles and the like, or through normal swinging motion occurring when lifting the cable, rope, chain or the like under load.

In operation, the keeper arms 143 function to allow for capturing a loop and positive retention of any cable, chain, rope or other loop once captured by the hook arms 132. The keeper arms 143 pivot around pivot pin 144 when capturing a loop, for example, as it enters along a hook arm 132. Keeper arms 143 are free to articulate around the pivot pin 144. Keeper arms 143 are configured to pivot out of the way. Recesses are provided in the support body 141 to pivot keeper arms 143 out of the way. A keeper spring 145 is biased to pivot keeper arms 143 back so as to return to an extended (outward) position in a soft stop position 146 such as, for example, after the cable slides down the arm, thereby trapping the cable behind the keeper arms 143. Each keeper arm 143 is limited in travel in the load releasing direction by the hard stop position 147 on the hook arms 132 as well as the soft stop position 146. The soft stop 146 position is advantageous because the keeper arm can be positioned out of the way by the capturing action. The hard stop 147 position is advantageous to prevent the payload captured loop either (1) to slip past preventing load release or (2) to escape therefrom during lift and payload transit. During payload release, the keeper arms 143 are advantageously positioned at the top of the support structure body 141 and out of the way, thereby allowing captured and transported payload to drop off the hook arms 132 when rotated downwardly to the open position. The soft stop position 146 for keeper arm 143 functions to position the keeper arm 143 slightly back from contacting the hook arm 132. In this manner, the soft stop position 146 advantageously prevents the hard stops 147 of the hook arms 132 that would occur when contacting the keeper arm 143 when the hook arms 132 are returning to the closed position from the open position. The soft stop position 146 will also allow the keeper arm 143 to travel passed the soft stop position 146 so as to contact the hook arm 132 at the hard stop 147 so as to hold a cable or other line and prevent inadvertent load release. The configuration of the keeper arm 143 and positioning has advantages of eliminating precise manufacturing and assembly adjustments to ensure a keeper arm 143 does not prevent a hook arm 132 from attaining the fully closed and over-center locked position, thereby interfering with the hard stop position, i.e., when the keeper arm 143 contacts the hook arm 132 to hold the line and prevent load release.

Figure 1B:
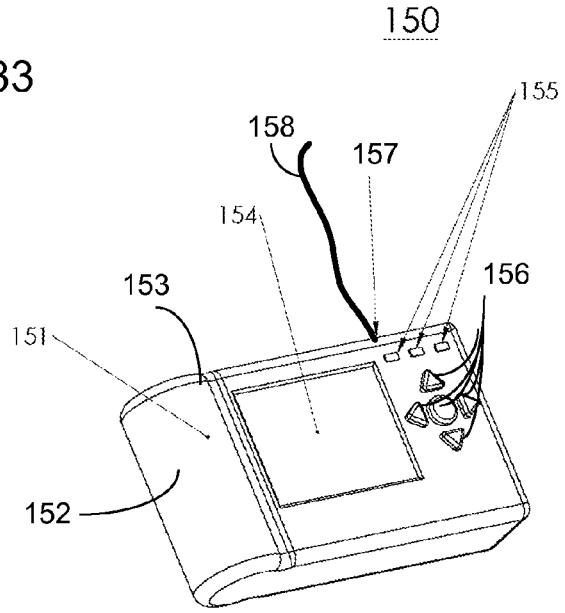

Referring to FIG. 1B, a controller 150 is provided to operate the hook assembly 100. The controller 150 is configured to perform to operate the hook assembly 100 to capture and release payloads without the need for ground attendants. For example, the controller activates the hook assembly 100 to capture and/or release the payload. Once the payload is released, the controller is then activated by the user to move the hook arms to the closed/capture position.

The controller 150 is an electronic devices that is programmable and can provide many functions, depending on the desires and needs of a particular operation, which features include:

a. Cycle counting for counting the number of times the hook has been cycled up and down, which is intended to provide a means to quantify usage duty, thus providing a means to track maintenance issues relative to duty time and provide predictive maintenance capability
b. Battery charge/voltage/health remaining
c. Actuator overload protection through power management
d. Feedback information for the operator such as "down and locked", fault causes such as failure mode messaging, and accidental payload-release protection.
e. Active control mode such as arm position nudge mode, or full up/down command mode
f. Position feedback/control
g. continuous position control of the hook assembly's capture arms
h. operational and usage status
i. hook arms can be quick-released by a releasable attachment mechanism of the drive mechanism;
j. hook arms can be re-engaged and controlled by the controller to the closed position; operational status of the clutch in the drive mechanism to protect the actuation mechanism against damage from overload and the like;

These features can be implemented by hardware, software or a combination thereof.

The controller 150 can be implemented by hardware and software so as to allow a user to control the articulation of the hooker arms 132, monitor system status, and usage information of the hook assembly 100. For example, the controller 150 can have a circuit board 151 enclosed in an enclosure 152, sealed with a gasket 153 so as to prevent and keep out environmental contaminants that is preferably waterproof.

The controller 150 can have a primary display 154 functioning to convey visual information about the operation of the hook assembly 100 such as, for example, displaying status messages, usage reports on a low energy usage display, a light emitting diode (LED) or a liquid crystal display (LCD). The controller 150 can have a secondary display 155 functioning to convey status of important information about the operation of the hook assembly 100 such as, for example, highlighting overall system function, status, faults, and the like using LED status lights of red, green and yellow to indicate the open position, locked position and non-functioning.

The controller 150 can have a plurality of inputs 156 for the user to provide input and change operation and display of the hook assembly 100. The controller 150 can have connection port(s) 157 for connecting to the hook assembly 100 by a hard wire connection. In an alternative embodiment, the controller 150 and hook assembly 100 can wirelessly connect and so as to operate the hook assembly 100, which can use the connection port 157 for antenna exit in wireless configuration, as illustrated in FIG. 7.

Referring to FIGS. 4A and 4B the operation of the present invention is described in a generic load capture scenario using the hook assembly 100 and the controller 150. Accordingly the hook arms 132 pivot, or rotate, about an arm pivot point 133 to capture a line 3 between a closed position shown in FIG. 4A and an open position as shown in 4B. The line 102 resides between the support structure body 141, the hook arms 132 and the keeper arms 143. The hook assembly 100 is made controllable by the control circuitry 114 and actuator 122 in the hook assembly 100 that interact with the controller 150. For example, the operator or user can raise or lower the hook arms 132, or quick release from the over-locked position, as is shown in FIG. 4A. This is particularly advantageous as the present invention provides a low cost efficient and effective apparatus, system and method to capture payloads without the use of ground or attendant personnel to secure the load on the lifting device and more particularly to a grappling hook capable of controlling the position of its grappling arms.

FIGS. 5A and 5B illustrate an operation utilizing the hook assembly 100 and controller 150 to capture a load 101 via a hoisting device 103 for example a crane, helicopter, unmanned aircraft, or any means deemed appropriate for the lifting operation. Initially, the hook assembly 100 is attached to the helicopter 103 by passing a line 102 around the pin 112 in the upper assembly 110. An operator places the hook arms 132 in the closed position (FIGS. 2, 4A and 5A) so as to enable capture of the line 102 as the helicopter 103 sweeps past a loop. The line 102 will pass by the biased keeper arm 143 to a position internal between the support structure body 141, the hook arm 132 and keeper arm 143. Once the line 102 is captured, the helicopter 103 can lift the load or object 101 as is shown in FIG. 5B. In this manner, once the load 101 is in the grasp of the hook assembly 100, the load 101 can be picked up by the hoisting device 103, such as a crane or helicopter, and carried to the desired drop-off point.

Figure 6A:
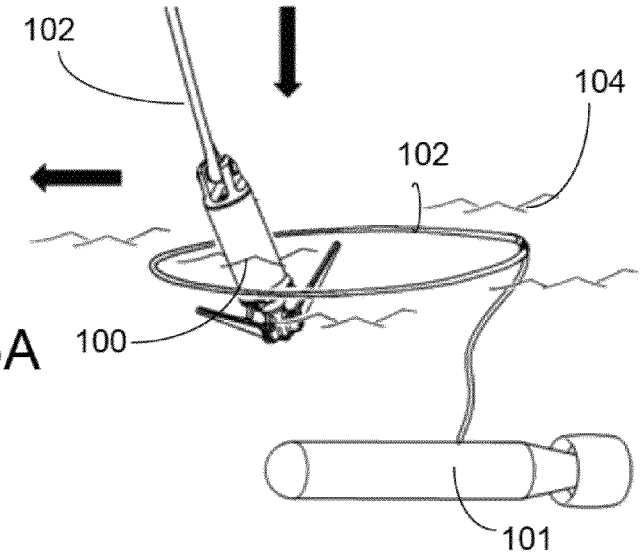
FIGS. 6A, 6B, and 6C illustrate a schematic view of various capture operations.
Figure 6B:
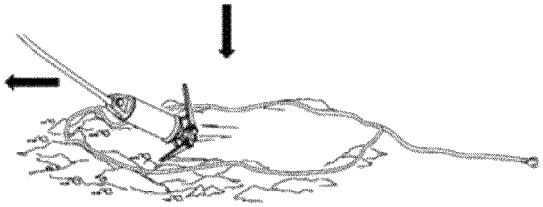
Figure 6C:
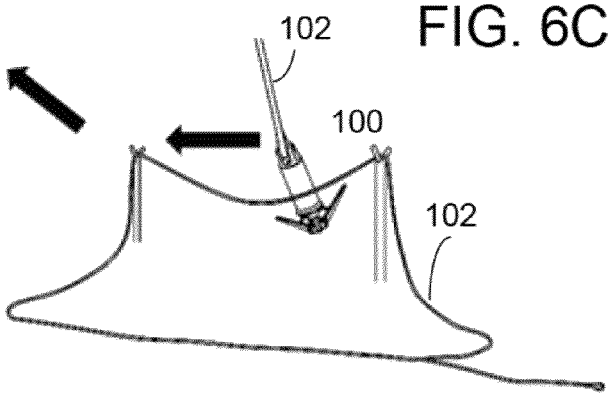

As is illustrated in FIGS. 6A, 6B and 6C, the present invention is useful in various operational tasks where the line or hook assembly is positioned or suspended by any acceptable means to allow the hook arms 132 to capture, or snag, the line to capture the object. For example, as is illustrated in FIG. 6A, the hook assembly 100 can be used to capture a floating line 102 attached to an object 101 that is in water 104. The hook assembly is positioned to drop in the loop of the line 102 by the hoisting device such as a helicopter 103. The helicopter 103 then moves laterally to capture the line 102 in the hook assembly 100 thereby transporting the object 101. In another operation on ground, as is illustrated in FIG. 6B, hook assembly 100 again is positioned to drop in the loop of the line 102 by the hoisting device such as a helicopter 103. The helicopter 103 then moves laterally to capture the line 102 in the hook assembly 100 thereby transporting an object 101 connected to the line. The closed position of the hook arms 132 advantageously provides improved sliding along the ground. In another operation on ground, as is illustrated in FIG. 6C, hook assembly 100 is positioned capture a loop of the line 102 by a hoisting device 103 as the hoisting device 103 moves the hook assembly 100 laterally to capture the line 102 thereby transporting any object 101 connected to the line. In these situations, once at the drop-off point, the load is placed on the ground or other supporting surface, and the controller is used to release the load by rotating the hook arms 132 in the downward direction by the drive assembly 130 of the hook assembly 100. The line 102 slides into the hook arms 132 and is kept in its grasp by gravity, with a secondary means of escape prevention provided by the keeper arms 143 located adjacent each hook arm 132.

In operation, the user is informed of load 101 release by visual verification, and hook assembly 100 operational status information presented to the controller 150 The user then lifts the hook assembly 100 using the hoisting platform 104 and closes the hook arms 132 using input 156, for example, an open/close switch on the controller 150. The hook assembly 100 is now ready for another load capture. The hook assembly 100 status of the hook arm 132 position is presented to the controller 150 via a position sensor 137 sensing contained within the hook assembly 100.

Referring to FIG. 7, the controller 150 can be connected to the hook assembly 100 via a wired or wireless connection. In a wired connection, a communication line or cable 158 electronically connects from port 157 of the controller to port 106 of the hook assembly to provide the operational commands to the hook assembly 100. The electronic connection can also transmit to the controller data and information on status and operation of the hook assembly 100. The controller 150 and hook assembly 100 can be adapted to be made wireless, where by wireless transceivers are added to the circuit board 151 of the controller and the control circuitry 114 so as to create a communication link between the controller 150 and the hook assembly 100.

As is illustrated in FIGS. 8A, 8B, 8C and 8D, the various positions of the hook assembly 100 are shown. For example, in FIG. 8A the open position has the hook arms 132 lowered. In FIG. 8B, the actuator 122 can be energized to raise the hook arms 132 as are shown in an intermediate position. In FIG. 8C, the hook arms 132 as are shown in an intermediate position but further towards the closed position. The keeper arms 143 allow the line 102 to pass by flexing out of the way during load 101 capture, and spring 145 biases the keeper arms 143 back into the soft stop position 146. In other conditions, if the line should move against the keeper arm 143 in the opposite direct, a hard stop 147 between the hook arm 132 and keeper arm 143 prevents the line from moving out of the load-releasing direction.

As is illustrated in FIGS. 9A, 9B, and 9C, release of the line 102 is shown as the hook arms 132 rotate down. In FIG. 9A, the line 102 is captured and held by the hook assembly 100. As is shown in FIG. 9B, for example, the line 102 drop or push off the hook assembly 100 by positioning the hook arm 132 in the open position or otherwise the position that extends past the primary pivot attachment as is shown in FIG. 9C. In this manner, a load 102 can be quickly released from the grasp of the hook assembly 100 by natural forces of gravity.

While certain configurations of structures have been illustrated for the purposes of presenting the basic structures of the present invention, one of ordinary skill in the art will appreciate that other variations are possible which would still fall within the scope of the appended claims. For example, power or energy source for the hook capture arm actuation can be provided by any acceptable means, whether an energy storage device such as a battery, pneumatic or hydraulic accumulator, or a continuous energy source such as direct wiring to the host lifting platform. Alternatively, the motor 122 and actuator can be a direct gear drive whereby the hook arms 132 incorporate gear teeth that interface with screw threads on the actuator 122 whereby the hook arms 132 are rotated between the open and close position as the corresponding screw threads in the actuator 122 turn or rotate thereby causing the gear teeth in said hook arms to cause rotation about hook arm pivot. Advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A hook assembly comprising:

a main body defining a housing for an actuator;

an upper assembly operably coupled to said main body for connecting a line for hoisting a load, said upper assembly configured with a cap and pin for providing a location for connecting the line thereto;

a lower assembly operably coupled to said main body for connecting to a load, said lower assembly comprising a support structure body configured to have means for mounting a plurality of keeper arms thereto movable between a retracted position, a soft stop position and a hard stop position, a central bore for aligning a drive shaft assembly with said actuator, and an end cap adapted to interact with said drive shaft assembly;

a clutch for connecting said drive assembly to said actuator assembly, said clutch being configured to limit a linear force applied to said actuator; and said drive shaft assembly is configured to move a plurality of hook arms between an open and closed position adapted capturing a line attached to a load, said plurality of hook arms being connected to said support structure body by said means for mounting at a pivot point of said plurality of hook arms; said plurality of hook arms being connected to said drive assembly by one or more intermediate links, whereby when said actuator is energized said drive assembly rotates said plurality of hook arms to a closed position, said plurality of hook arms configured to be rotated by gear teeth in said plurality of hook arms cooperating with screw threads in said actuator whereby said actuator rotating said screw threads provides rotation about said pivot point by said gear teeth in said plurality of hook arms.

2. The hook assembly as in claim 1 wherein said clutch includes a position sensor configured to provide a position reading to said actuator so as to re-engage said actuator output shaft to said drive shaft assembly and connecting by said clutch.

3. The hook assembly as in claim 1 wherein said plurality of keeper arms may be configured to be biased in said soft stop position.

4. The hook assembly as in claim 1 wherein said controller provides said hook assembly operational and usage status.

5. A hook assembly comprising:

a main body defining a housing for an actuator;

an upper assembly operably coupled to said main body for connecting a line for hoisting a load, said upper assembly configured with a cap and pin for providing a location for connecting the line thereto;

a lower assembly operably coupled to said main body for connecting to a load, said lower assembly comprising a support structure body configured to have means for mounting a plurality of keeper arms movable between a retracted position, a soft stop position and a hard stop position, a central bore for aligning a drive shaft assembly with said actuator, and an end cap adapted to interact with said drive shaft assembly;

a clutch for connecting said drive assembly to said actuator assembly, said clutch being configured to limit a linear force applied to said actuator; and said drive shaft assembly is configured to move a plurality of hook arms between an open and closed position adapted capturing a line attached to a load, said plurality of hook arms being connected to said support structure body by said means for mounting at a pivot point of said plurality of hook arms; said plurality of hook arms being connected to said drive assembly by one or more intermediate links, whereby when said actuator is energized said drive assembly rotates said plurality of hook arms to a closed position;

wherein said actuator is configured with an actuator output shaft, said actuator output shaft being generally cylindrical and having a ringed notch and a tapered nose at a distal end for connecting to said drive shaft assembly and said clutch.

6. The hook assembly as in claim 5 wherein said clutch includes a spring operably coupled to said actuator output shaft and said drive shaft assembly at said ringed notch, said spring being biased at a predetermined load so to release the drive assembly from said actuator output shaft when said limit of said linear force designed to be applied to said actuator is reached.

7. The hook assembly as in claim 5 wherein said actuator of the hook assembly is controlled by a controller, whereby said controller interacts with said actuator to energize a motor and gearbox to provide linear motion to said actuator output shaft, whereby said linear motion of said actuator output shaft moves said hook arms of said drive shaft assembly between said open and closed positions.

8. A hook assembly as in claim 5 wherein said controller can be wired or wireless.

9. The hook assembly as in claim 5 wherein said gear teeth in said plurality of hook arms cooperating with screw threads in said actuator are configured to provide rotation about said pivot point.

10. A controllable hook system comprising:

a hook assembly comprising:

a main body defining a housing for an actuator;

an upper assembly operably coupled to said main body for connecting a line for hoisting a load, said upper assembly configured with a cap and pin for providing a location for connecting the line thereto;

a lower assembly operably coupled to said main body for connecting to a load, said lower assembly comprising a support structure body configured to have means for mounting a plurality of keeper arms thereto movable between a retracted position, a soft stop position and a hard stop position, a central bore for aligning a drive shaft assembly with said actuator, and an end cap adapted to interact with said drive shaft assembly;

a clutch for connecting said drive assembly to said actuator assembly, said clutch being configured to limit a linear force applied to said actuator;

said drive assembly is configured to move a plurality of hook arms between an open and closed position adapted capturing a line attached to a load, said plurality of hook arms being connected to said support structure body by said means for mounting at a pivot point of said plurality of hook arms; said plurality of hook arms being connected to said drive assembly by one or more intermediate links, whereby when said actuator is energized said drive assembly rotates said plurality of hook arms to a closed position, said plurality of hook arms configured to be rotated by gear teeth in said plurality of hook arms cooperating with screw threads in said actuator whereby said actuator rotating said screw threads provides rotation about said pivot point by said gear teeth in said plurality of hook arms; and a controller for operating said hook assembly, said controller interacting with a control circuit to energize said actuator driving said drive assembly, whereby when said actuator is energized said hook arms pivot between an open position and said closed position, whereby said hook assembly can capture loads without the use of attendant personnel to secure the load to the hook assembly.

11. The controllable hook system as in claim 10 wherein said hook assembly further comprises a rechargeable battery system for energizing said actuator.

12. The controllable hook system as in claim 10 wherein said controller is configured with an electronic circuit and display screen to track and provides hook assembly operational and usage status.

13. The controllable hook system y as in claim 12 wherein said controller tracks and displays opening and closing cycles to provide battery usage and hook assembly health information.

14. The controllable hook system as in claim 12 wherein said controller provides system failure information for operational and maintenance of the hook assembly.

15. The controllable hook system as in claim 12 wherein said controller can be wired or wireless.

* * * * *